US010337280B2

(12) United States Patent
Falconer

(10) Patent No.: US 10,337,280 B2
(45) Date of Patent: Jul. 2, 2019

(54) RESISTING COLLAPSE OF DOWNHOLE TOOLS

(71) Applicant: Halliburton Energy Services, Inc., Houston, TX (US)

(72) Inventor: Roderick Brand Falconer, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 762 days.

(21) Appl. No.: 14/412,001

(22) PCT Filed: Oct. 25, 2013

(86) PCT No.: PCT/US2013/066789

§ 371 (c)(1),
(2) Date: Dec. 30, 2014

(87) PCT Pub. No.: WO2015/060861

PCT Pub. Date: Apr. 30, 2015

(65) Prior Publication Data

US 2015/0233189 A1 Aug. 20, 2015

(51) Int. Cl.
*E21B 33/12* (2006.01)
*E21B 33/1295* (2006.01)
(Continued)

(52) U.S. Cl.
CPC ..... *E21B 33/1295* (2013.01); *E21B 33/1285* (2013.01); *E21B 17/18* (2013.01); *E21B 33/12* (2013.01); *E21B 34/06* (2013.01)

(58) Field of Classification Search
CPC ..... E21B 33/1285; E21B 33/1295
See application file for complete search history.

(56) References Cited

U.S. PATENT DOCUMENTS 4,538,337 A 9/1985 Holbrook et al.
5,205,567 A 4/1993 Quinlan et al.
(Continued)

FOREIGN PATENT DOCUMENTS

WO WO 2012/177315 12/2012

OTHER PUBLICATIONS

Authorized Officer Han, Joong Sub, International Search Report and Written Opinion in International Application No. PCT/US2013/066789, dated Jul. 24, 2014, 17 pages.
(Continued)

*Primary Examiner* — Giovanna C. Wright
*Assistant Examiner* — Kristyn A Hall
(74) *Attorney, Agent, or Firm* — Scott Richardson; Parker Justiss, P.C.

(57) ABSTRACT

A downhole tool includes a housing including a connection for coupling with a conveyance that extends from a terranean surface into a wellbore; a first tubular member coupled with the housing, the first tubular member including a first compound cylinder; and a second tubular member coupled with the housing and concentrically positioned radially adjacent the first tubular member, the second tubular member including a second compound cylinder, the first and second tubular members defining a pressure chamber between an inner surface of the first tubular member and an outer surface of the second tubular member.

24 Claims, 4 Drawing Sheets

(51) Int. Cl.

| | |
|---|---|
| ***E21B 33/128*** | (2006.01) |
| *E21B 17/18* | (2006.01) |
| *E21B 34/06* | (2006.01) |

(56) References Cited

U.S. PATENT DOCUMENTS

| | | | | |
|---|---|---|---|---|
| 5,398,755 | A | 3/1995 | Eslinger et al. | |
| 6,471,914 | B2 | 10/2002 | Platz et al. | |
| 6,976,536 | B2 | 12/2005 | Simpson et al. | |
| 7,090,006 | B2 | 8/2006 | Salama | |
| 7,441,596 | B2 | 10/2008 | Wood et al. | |
| 8,056,279 | B2 | 11/2011 | Carter et al. | |
| 2003/0146229 | A1* | 8/2003 | Munoz | F17C 1/00 220/745 |
| 2005/0005668 | A1 | 1/2005 | Duggan et al. | |
| 2007/0151360 | A1 | 7/2007 | Ring et al. | |
| 2009/0321081 | A1 | 12/2009 | Schramm et al. | |
| 2010/0012330 | A1* | 1/2010 | Ezell | E21B 33/1285 166/387 |
| 2010/0147538 | A1 | 6/2010 | Gaudette et al. | |
| 2012/0018169 | A1 | 1/2012 | Caminari et al. | |

OTHER PUBLICATIONS

Bihamta et al., "A Numerical Study of Swage Autofrettage of Thick-Walled Tubes" Materials & Design, vol. 28, Issue 3, 2007, 1 page.

Hearn, "Mechanics of Materials 1," Third edition, University of Warwick, United Kingdom, Jul. 1997, 22 pages.

Hosseinian et al., "An Analytical Framework for the Solution of Autofrettaged Tubes Under Constant Axial Strain Condition" Journal of Pressure Vessel Technology, vol. 131, Issue 6, Jun. 12, 2001, Dec. 2009, 2 pages.

Lee et al., "Autofrettage process analysis of compund cylinder based on the elastic-perfectly plastic and strain hardening stress-strain curve," Journal of Mechanical Science and Technology, Aug. 19, 2009, 8 pages.

* cited by examiner

RESISTING COLLAPSE OF DOWNHOLE TOOLS

CROSS-REFERENCE TO RELATED APPLICATIONS

This application is a 371 U.S. National Stage Application of and claims the benefit of priority to PCT Application Serial No. PCT/US2013/066789, filed on Oct. 25, 2013 entitled "Resisting Collapse of Downhole Tools", the contents of which are hereby incorporated by reference.

TECHNICAL BACKGROUND

This disclosure relates to systems and methods for resisting deformation of downhole tools in a wellbore.

BACKGROUND

As oil and gas discoveries continue to be found at deeper depths, and under different surfaces (e.g., land and sea), downhole tools that operate in such locations often operate interventionlessly by, for example, utilizing the ambient well bore hydrostatic pressure. Such operation may be beneficial to enable safe and economic access and recovery of reservoir oil or gas reserves. Hydrostatically enabled tools such as hydrostatic set packers, hydrostatic enabled plugging devices, for instance, may be used more and more. Current technology may be limited by the physical properties of materials used to manufacture such tools.

DETAILED DESCRIPTION

Figure 1:
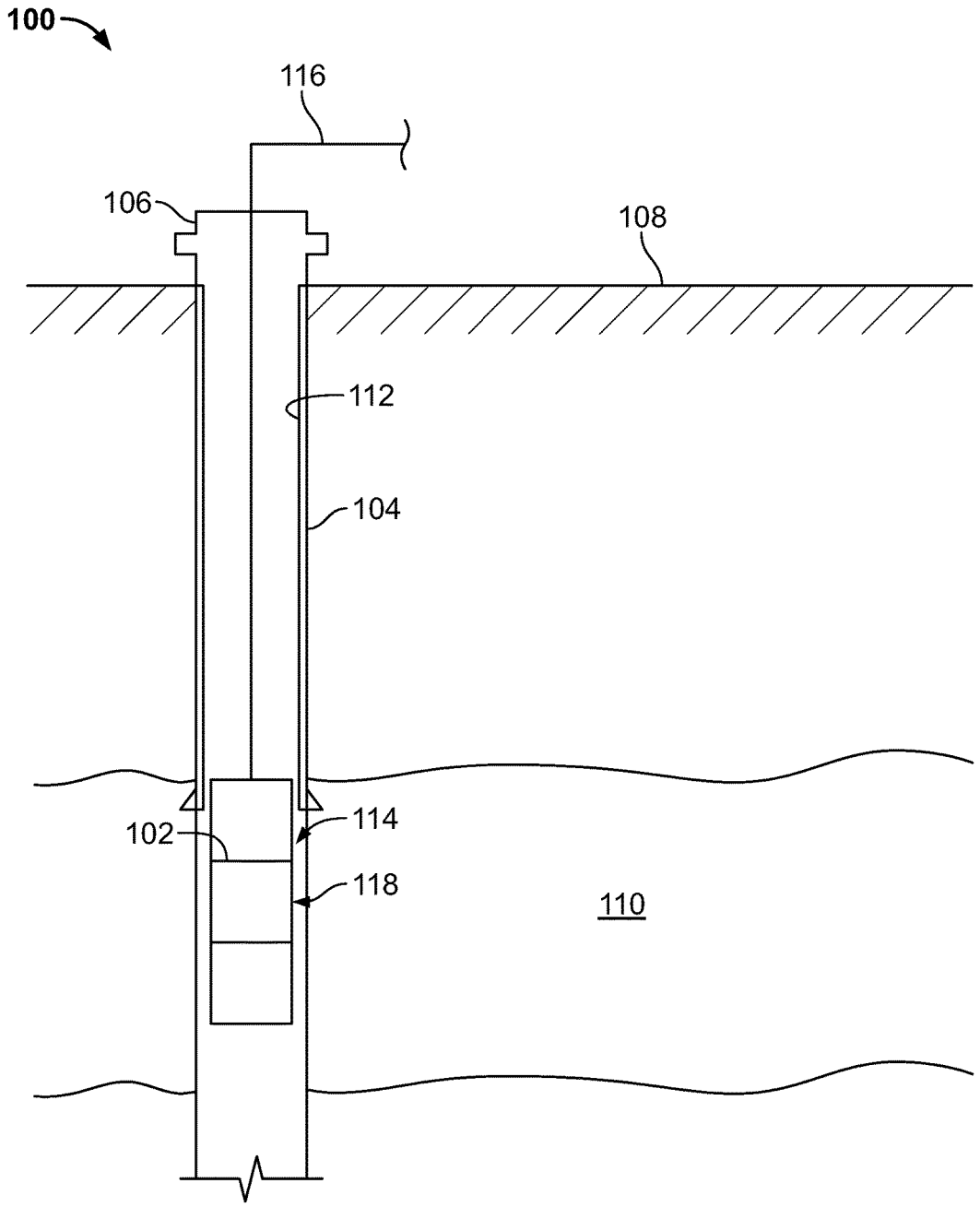
FIG. 1 is a cross-sectional view of an example well system that includes a deformation resistant downhole tool.

The present disclosure describes implementations of a downhole tool that includes one or more tubular members that are formed as a thick cylinder, such as a compound cylinder, wire-wrapped tubular member, auto-frettaged cylinder, or other form of thick cylinder that resists deformation in response to a pressure difference exerted on the member. In some implementations, concentric tubular members formed as thick cylinders define a pressure chamber held at atmospheric pressure (e.g., exactly or approximately). One or more of the tubular members are exposed, when the tool is in a set or run-in position, to atmospheric pressure on one radial surface of the member and a hydrostatic pressure on another, opposite radial surface of the member. In some aspects, the hydrostatic pressure is greater than the atmospheric pressure but the tubular member resists deformation based on the thick cylinder construction of the member.

In an example general implementation according to the present disclosure, a downhole tool includes a housing including a connection for coupling with a conveyance that extends from a terranean surface into a wellbore; a first tubular member coupled with the housing, the first tubular member including a first compound cylinder; and a second tubular member coupled with the housing and concentrically positioned radially adjacent the first tubular member, the second tubular member including a second compound cylinder, the first and second tubular members defining a pressure chamber between an inner surface of the first tubular member and an outer surface of the second tubular member.

In a first aspect combinable with the general implementation, the pressure chamber includes a second fluid (e.g., air) at or near atmospheric pressure.

A second aspect combinable with any of the previous aspects further includes a bore that extends through the tool and defined by an inner surface of the second tubular member, the bore for at least partially enclosing a fluid at or near a hydrostatic pressure of an annulus between the tool and the wellbore at a downhole position of the tool.

In a third aspect combinable with any of the previous aspects, the hydrostatic pressure is greater than atmospheric pressure.

In a fourth aspect combinable with any of the previous aspects, the pressure chamber is fluidically sealed from the annulus of the wellbore at the downhole position of the tool.

In a fifth aspect combinable with any of the previous aspects, at least one of the first or second tubular members resists deformation based on a difference in the hydrostatic pressure and the atmospheric pressure.

In a sixth aspect combinable with any of the previous aspects, at least one of the first or second compound cylinders includes a plurality of cylindrical members, at least one of the plurality of cylindrical members plastically deformed into another of the plurality of cylindrical members.

In a seventh aspect combinable with any of the previous aspects, the one of the plurality of cylindrical members includes a hoop stress having a radially outward bias.

In an eighth aspect combinable with any of the previous aspects, the downhole tool includes one of a packer, a plug, a setting tool, a tester valve, or an interval control valve.

In a ninth aspect combinable with any of the previous aspects, the second tubular member includes a mandrel and the first tubular member includes an outer sleeve that rides, at least partially, on the mandrel.

In another general implementation, a downhole tool system includes a connection sub-assembly that includes a connector for coupling with a conveyance that extends from a terranean surface into a wellbore; a hydrostatic sub-assembly that includes an atmospheric chamber fluidically sealed from an annulus of the wellbore by a plurality of tubular members at a downhole position of the system, at least one of the tubular members including a thick cylinder; and an actuation sub-assembly including an actuation sleeve for actuating the hydraulic sub-assembly based on hydrostatic pressure of the annulus.

In a first aspect combinable with the general implementation, the thick cylinder includes one of a compound cylinder, a wire-wound cylinder, or an autofrettaged cylindrical member.

In a second aspect combinable with any of the previous aspects, the compound cylinder includes at least two tubular members concentrically fitted together having a hoop stress radially biased away from a centerline of the hydrostatic sub-assembly.

In a third aspect combinable with any of the previous aspects, another of the plurality of tubular members includes another thick cylinder, both thick cylinders defining the atmospheric chamber, the atmospheric chamber including a fluid at or near atmospheric pressure.

In a fourth aspect combinable with any of the previous aspects, the hydrostatic pressure is greater than atmospheric pressure.

In a fifth aspect combinable with any of the previous aspects, thick cylinder resists deformation based on a difference in the hydrostatic pressure and the atmospheric pressure.

In a sixth aspect combinable with any of the previous aspects, the hydrostatic pressure is up to about 20,000 psi.

In another general implementation, a method includes running a downhole tool connected with a conveyance into a wellbore, the downhole tool including a housing coupled with the conveyance; a first tubular member coupled with the housing, the first tubular member including a first compound cylinder; and a second tubular member coupled with the housing and concentrically positioned radially adjacent the first tubular member, the second tubular member including a second compound cylinder, the first and second tubular members defining a pressure chamber between an inner surface of the first tubular member and an outer surface of the second tubular member. The method including setting the downhole tool at a determined depth in the wellbore; and exposing at least one of the first or second tubular members to an annulus pressure in the wellbore that is greater than a fluid pressure in the pressure chamber, where the at least one of the first or second tubular members resists deformation based on the difference in the annulus pressure and the fluid pressure in the pressure chamber.

A first aspect combinable with the general implementation further includes exposing at least one of the first or second tubular members to atmospheric pressure in the pressure chamber, the annulus pressure greater than atmospheric pressure.

A second aspect combinable with any of the previous aspects further includes exposing an inner radial surface of the second tubular member to the annulus pressure in a bore of the downhole tool; exposing an outer radial surface of the second tubular member to the atmospheric pressure in the pressure chamber; and operating the downhole tool at the determined depth without deformation of the second tubular member.

A third aspect combinable with any of the previous aspects further includes exposing an outer radial surface of the first tubular member to the annulus pressure in an annulus between the downhole tool and the wellbore; exposing an inner radial surface of the first tubular member to the atmospheric pressure in the pressure chamber; and operating the downhole tool at the determined depth without deformation of the first tubular member.

In a fourth aspect combinable with any of the previous aspects, operating the downhole tool at the determined depth without deformation of the first tubular member includes operating the downhole tool at the determined depth without deformation of the first tubular member based on a hoop stress of the first compound cylinder oriented in a radially outward direction.

In a fifth aspect combinable with any of the previous aspects, operating the downhole tool includes one of operating the downhole tool as a packer, operating the downhole tool as a plug, operating the downhole tool as a setting tool, operating the downhole tool as a tester valve, or operating the downhole tool as an interval control valve.

In a sixth aspect combinable with any of the previous aspects, operating the downhole tool includes moving the first tubular member relative to the second tubular member to adjust a volume of the pressure chamber.

Various implementations of a deformation resistant downhole tool in accordance with the present disclosure may include one, some, or all of the following features. For example, the downhole tool may be utilized in deeper wells and/or in higher pressure geologic formations than conventional downhole tools. In some aspects, a deformation resistant downhole tool may have larger performance characteristics and may facilitate larger through bores (e.g., due to smaller tool diameters) and better oil and/or gas recovery. As another example, the deformation resistant tool may facilitate completion deployment in complex reservoirs.

FIG. 1 is a cross-sectional view of an example well system 100 that includes a deformation resistant downhole tool constructed in accordance with the concepts herein. The well system 100 is provided for convenience of reference only, and it should be appreciated that the concepts herein are applicable to a number of different configurations of well systems. As shown, the well system 100 includes a downhole tool 102 that is part of a downhole assembly 118 within a substantially cylindrical wellbore 104 that extends from a well head 106 at a terranean surface 108 through one or more subterranean zones of interest 110. In FIG. 1, the wellbore 104 extends substantially vertically from the terranean surface 108. However, in other instances, the wellbore 104 can be of another position, for example, deviates to horizontal in the subterranean zone 110, entirely substantially vertical or slanted, it can deviate in another manner than horizontal, it can be a multi-lateral, and/or it can be of another position.

In some aspects, the well system 100 may be deployed on a body of water rather than the terranean surface 108. For instance, in some embodiments, the terranean surface 108 may be an ocean, gulf, sea, or any other body of water under which hydrocarbon-bearing formations may be found. In short, reference to the terranean surface 108 includes both land and water surfaces and contemplates forming and/or developing one or more wellbore systems 100 from either or both locations. In some aspects, the well system 100 may be a subsea well (e.g., wellhead, Christmas tree, and production-control equipment located on a seabed). In some aspects, the well system 100 may be a deep well system, such as a well system in which the wellbore 104 may extend approximately 30,000 feet or more from the terranean surface 108 (e.g., in TVD or measured depth from a well head). In some aspects, a hydrostatic pressure in the wellbore 104 at such distances from the well head may be up to about 20,000 psi.

At least a portion of the illustrated wellbore 104 may be lined with a casing 112, constructed of one or more lengths of tubing, that extends from the well head 106 at the terranean surface 108, downhole, toward an end of the wellbore 104. The casing 112 provides radial support to the wellbore 104 and seals against unwanted communication of fluids between the wellbore 104 and surrounding formations. Here, the casing 112 ceases at or near the subterranean zone 110 and the remainder of the wellbore 104 is an open hole, e.g., uncased. In other instances, the casing 112 can extend to the bottom of the wellbore 104 or can be provided in another position.

As illustrated, the downhole assembly 118 is coupled to a conveyance 116 such as a wireline, a slickline, an electric line, a coiled tubing, straight tubing, or the like. The downhole assembly 118 includes the downhole tool 102. Generally, the downhole tool 102 comprises a deformation resistant tool that may withstand relatively high hydrostatic pressures in a wellbore compared to convention non-deformation resistant downhole tool. In some aspects, deformation resistant may mean that one or more tubular components of the downhole tool 102 may resist collapse (e.g., radially inward toward a centerline of such tubular components) and/or be prevented from collapsing collapse in deep well environments. Thus, in some aspects, the downhole tool 102 may be used and operated in deeper wells than conventional tools that do not resist collapse or deformation according to the present disclosure. Further, in some aspects, the downhole tool 102 may include one or more components (e.g., tubular components) that have thinner walls relative to conventional tools that do not resist collapse or deformation according to the present disclosure. With such thinner walls, an overall size, or outer diameter of the downhole tool 102 may be decreased while still retaining similar collapse resistance in shallower wells (e.g., wells drilled with a TVD less than deep wells).

In some aspects, one or more tubular components of the downhole tool 102 may comprise or be manufactured as a thick cylinder, e.g., a compound cylinder, a wire wrapped tubular or compound cylinder, or an autofrettaged cylinder, to name a few examples. A tubular component, as a thick cylinder, in some aspects, may be formed to withstand larger radially compressive forces without deformation or with negligible deformation, as compared to a thin or conventional tubular member. In some aspects, negligible deformation may include some deformation of a tubular member but not enough to impact operation of the downhole tool.

A tubular member of the downhole tool 102, as a compound cylinder, may include a more uniform hoop stress distribution by fitting multiple tubulars together, e.g., by shrinking one tubular onto the outside of another tubular and so on. There may be two or more tubulars shrink-fit together to form a compound cylinder. In some aspects, such shrink-fitting may be performed at an elevated temperature. When an outer tubular contracts, on cooling, an inner tubular may be brought into a state of compression. The outer tubular may conversely be brought into a state of tension. Upon subjecting the resultant compound cylinder to internal pressure, a resultant hoop stress may be a sum of the stresses resulting from internal pressure and the stresses resulting from shrinkage. As a result, a relatively smaller total fluctuation of hoop stress is obtained and such hoop stress, controlled to resist collapse, may have a radially outward bias.

In some aspects, one or more tubular members of the downhole tool 102, as a thick cylinder, may be manufactured by an auto-frettage process. In some aspects, an auto-frettage process may cause a tubular to plastically yield such that a highest stress point is at or near an inside or outside radius of the tubular member (e.g., depending on whether collapse or bursting is a concern) For example, an internal pressure may be exerted on the tubular member. As the internal pressure is increased sufficiently, yielding of the tubular material can take place at this position. As the pressure is increased further, plastic penetration takes place deeper into the tubular wall and eventually the whole tubular will yield. If the pressure is such that plastic penetration occurs only partly into the tubular wall, on release of that pressure, an elastic outer portion of the tubular may be prevented from returning to its original dimensions by the permanent deformation of the yielded material. The elastic material may be held in a state of residual tension and the inside is brought into residual compression. In some aspects, auto-frettage may include similar effects on a tubular member (e.g., with respect to radial strength and other mechanical properties) as compounding cylinders. For example, by serial loading cycles, the tubular member may be able to withstand a higher internal or external pressure since the compressive residual stress at the inside or outside surface of the tubular member has to be overcome before this region begins to experience tensile stresses.

Figure 2A:
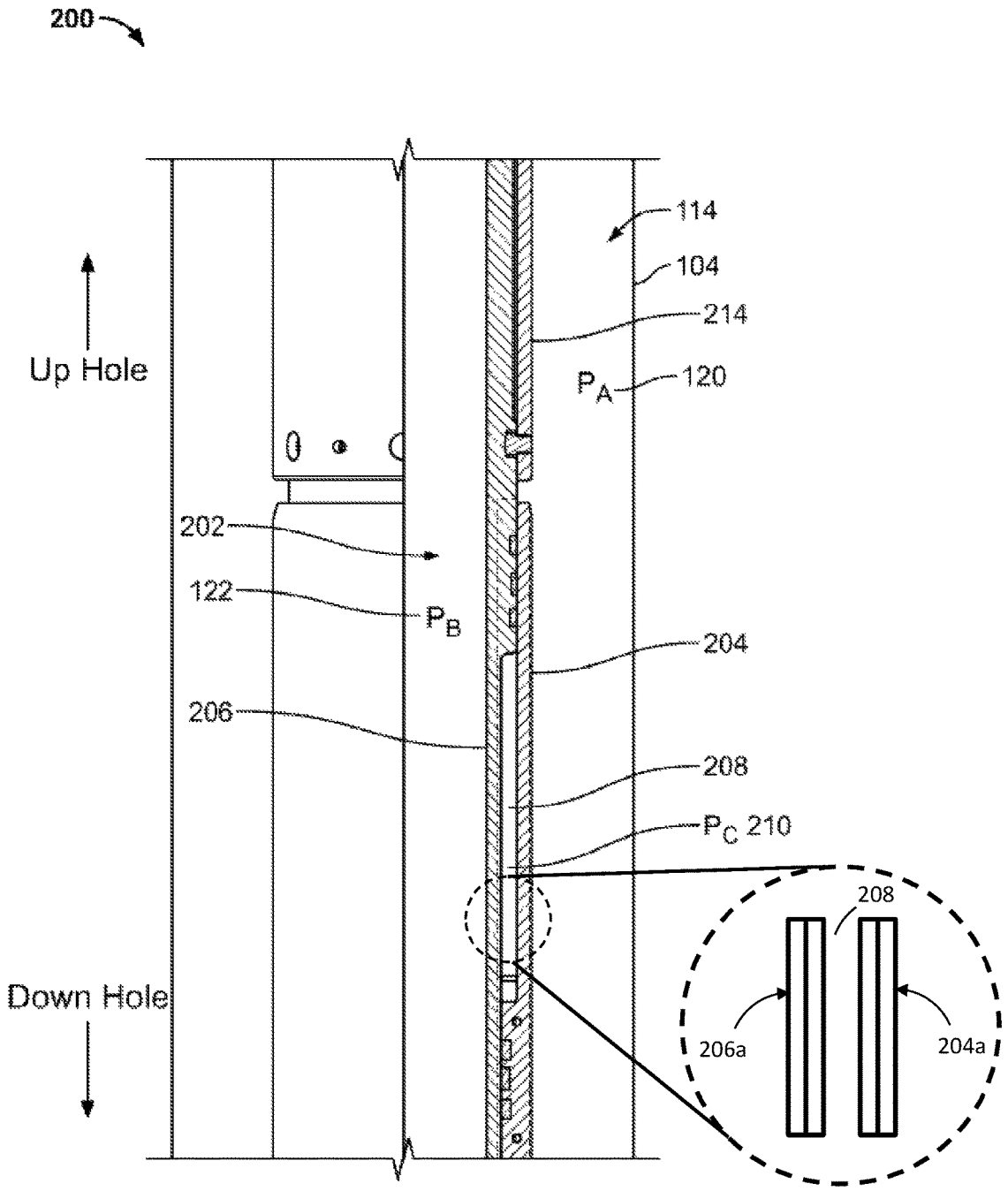
FIGS. 2A-2C are cross-sectional views of example deformation resistant downhole tools.
Figure 2B:
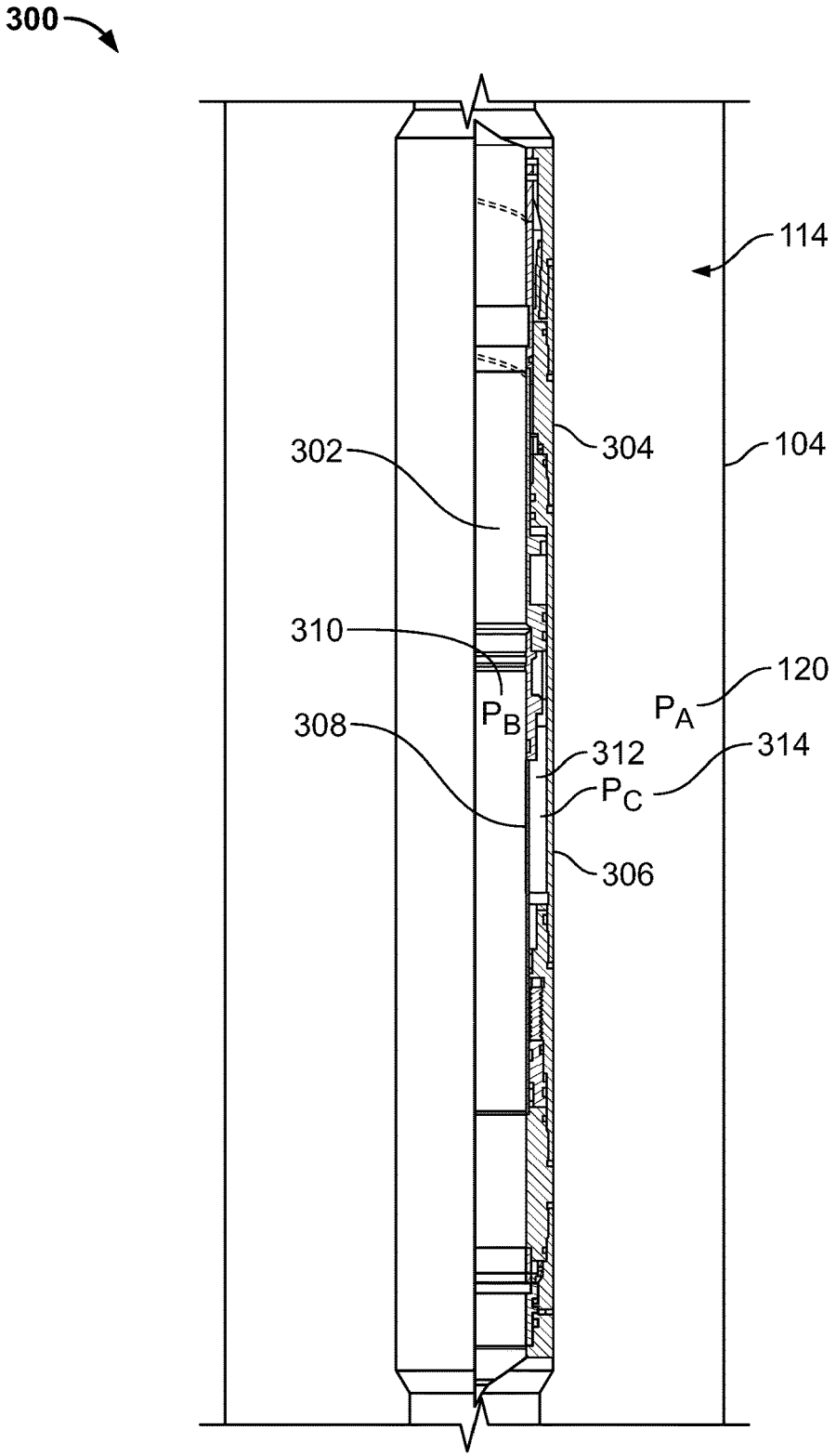
Figure 2C:
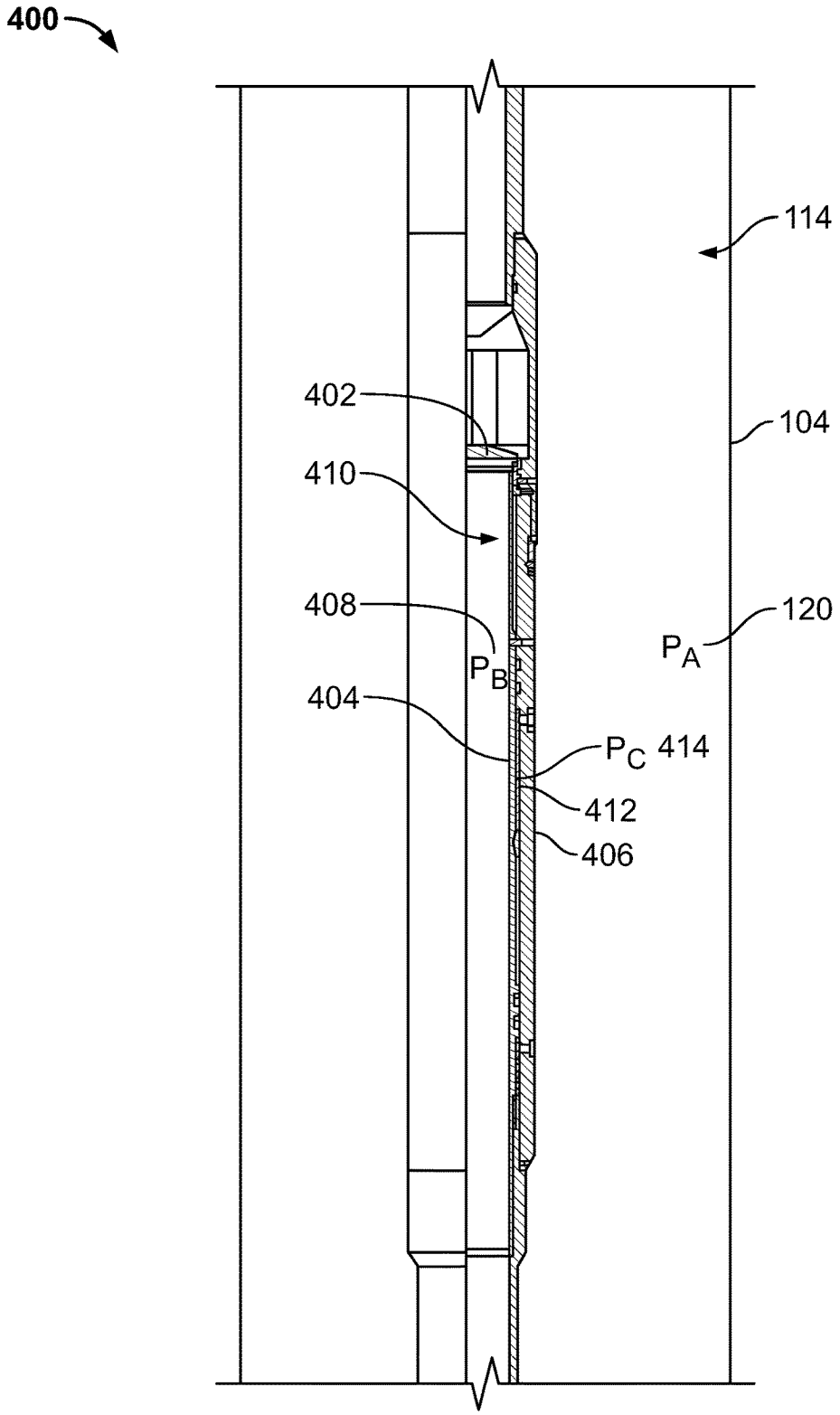

FIGS. 2A-2C are cross-sectional views of example deformation resistant downhole tools. For example, FIG. 2A illustrates an example hydrostatically set packer 200, FIG. 2B illustrates an example downhole plug 300, and FIG. 2C illustrates an example downhole tester valve 400. These example downhole tools, as explained more fully below, may include one or more tubular components that is formed as a thick cylinder, such as a compound cylinder, a wire-wrapped cylinder or a tubular made according to an auto-frettage technique as described above. In some aspects, one or more of the example tools may be able to withstand higher hydrostatic pressures relative to conventional versions of such tools that do not include one or more tubular components formed as a compound cylinder and/or manufactured according to an auto-frettage technique.

FIG. 2A illustrates an example downhole tool of a hydrostatically set packer 200. In some aspects, the packer 200 may allow for sealing of the annulus 114 in an intervention-less, single trip installation that does not require a plugging device in order to set the packer 200. The packer 200 is illustrated in a downhole position in the wellbore 104, in which a fluid is circulated and/or contained in the annulus 114. When actuated, the packer 200 may provide for a sealing barrier in the annulus 114 to prevent fluid (e.g., oil and/or gas) from circulating in the annulus 114 to the terranean surface. As illustrated, the packer 200 includes a bore 202, a housing 214, an outer sleeve 204, and a mandrel 206. In some aspects, the outer sleeve 204 and the mandrel 206 comprise at least a portion of a hydrostatic sub-assembly of the downhole packer 200.

As illustrated, the outer sleeve 204 and the mandrel 206 define a pressure chamber 208 therebetween. One or both of the outer sleeve 204 and mandrel 206 may be formed as a thick cylinder as described above. In the illustrated embodiment, and more particularly as shown in zoomed in portion of FIG. 2A, the outer sleeve 204 is configured as first compound cylinder 204*a*, and the mandrel 206 is configured as a second compound cylinder 206*a*, both of which define pressure chamber 208. As illustrated, the annulus is at a hydrostatic pressure, PA 120, the bore 202 also encloses and/or includes a fluid at the hydrostatic pressure, PB 122, and the pressure chamber 208 encloses and/or includes a fluid (e.g., air) at or near atmospheric pressure, PC 210. In the downhole position as shown in FIG. 2A, PA 120 and PB 122 may be equal (e.g., exactly or substantially) and greater than PC 210. Thus, in a downhole position, the mandrel 206 may be subject to PB 122 on an inner radial surface and PC 210 on an outer radial surface, but may still resist deformation (e.g., burst) based on being constructed as a thick cylinder. Likewise, in the downhole position, the outer sleeve 204 may be subject to PC 210 on an inner radial surface and PA 120 on an outer radial surface, but may still resist deformation (e.g., collapse) based on being constructed as a thick cylinder.

FIG. 2B illustrates an example downhole plug 300. In some aspects, the downhole plug 300 comprises a tubing mounted plug that includes one or more tubular members formed as thick cylinders. The downhole plug 300 is illustrated in a downhole position in the wellbore 104, in which a fluid is circulated and/or contained in the annulus 114. When actuated, the downhole plug 300 may introduce a barrier in the wellbore 104 in a completion, so that the completion can be pressure tested while it is being executed. Further, the downhole plug 300 can be used as a downhole barrier to remove a blowout preventer and install a Christmas tree. As illustrated, the downhole plug 300 includes a bore 302, an interlock mechanism 304, an outer sleeve 306, and a mandrel 308. In some aspects, the outer sleeve 306 and the mandrel 308 comprise at least a portion of a hydrostatic sub-assembly of the downhole tool 300.

As illustrated, the outer sleeve 306 and the mandrel 308 define a pressure chamber 312 therebetween. One or both of the outer sleeve 306 and mandrel 308 may be formed as a thick cylinder as described above. As illustrated, the annulus is at a hydrostatic pressure, $P_A$ 120, the bore 302 also encloses and/or includes a fluid at the hydrostatic pressure, $P_B$ 310, and the pressure chamber 312 encloses and/or includes a fluid (e.g., air) at or near atmospheric pressure, $P_C$ 314. In the downhole position as shown in FIG. 2B, $P_A$ 120 and $P_B$ 310 may be equal (e.g., exactly or substantially) and greater than $P_C$ 314. Thus, in a downhole position, the mandrel 308 may be subject to $P_B$ 310 on an inner radial surface and $P_C$ 314 on an outer radial surface, but may still resist deformation (e.g., burst) based on being constructed as a thick cylinder. Likewise, in the downhole position, the outer sleeve 306 may be subject to $P_C$ 314 on an inner radial surface and $P_A$ 120 on an outer radial surface, but may still resist deformation (e.g., collapse) based on being constructed as a thick cylinder.

FIG. 2C illustrates an example downhole tester valve 400. In some aspects, the tester valve 400 provides a temporary barrier which, when installed in a downhole position in the wellbore 104, provides a pressure barrier from above which allows for the pressure testing of tubing and/or setting of production packers or other hydraulically operated devices. In some aspects, the tester valve 400 may be actuated once a predetermined combined hydrostatic/applied pressure reaches a particular value so that a flapper 402 may be pushed out of a flow path in a bore 410 of the valve 400.

As illustrated, the tester valve 400 includes a sleeve 406 and a mandrel 404 that define a pressure chamber 412 therebetween. One or both of the sleeve 406 and mandrel 404 may be formed as a thick cylinder as described above. As illustrated, the annulus is at a hydrostatic pressure, $P_A$ 120, the bore 410 also encloses and/or includes a fluid at the hydrostatic pressure, $P_B$ 408, and the pressure chamber 412 encloses and/or includes a fluid (e.g., air) at or near atmospheric pressure, $P_C$ 414. In the downhole position as shown in FIG. 2C, $P_A$ 120 and $P_B$ 408 may be equal (e.g., exactly or substantially) and greater than $P_C$ 414. Thus, in a downhole position, the mandrel 404 may be subject to $P_B$ 408 on an inner radial surface and $P_C$ 414 on an outer radial surface, but may still resist deformation (e.g., burst) based on being constructed as a thick cylinder. Likewise, in the downhole position, the sleeve 406 may be subject to $P_C$ 414 on an inner radial surface and $P_A$ 120 on an outer radial surface, but may still resist deformation (e.g., collapse) based on being constructed as a thick cylinder.

An example operation using one of the example downhole tools 200, 300, or 400 described above may be as follows. For example, the downhole tool may be run into a wellbore from a terranean surface on a conveyance, such as a drill string, wireline, slickline, or other conveyance. Generally, in some aspects, the downhole tool may include one or more tubular members (as described above with respect to FIGS. 2A-2C) that include or comprise compound cylinders (or other forms of thick cylinders). In some aspects, the downhole tool may include an atmospheric chamber defined as radially positioned between the tubular members. A fluid in the atmospheric chamber may be at atmospheric pressure (or other pressure at or near the terranean surface).

Next, the downhole tool may be set at a particular depth in the wellbore. In some aspects, the downhole tool may be set in a vertical wellbore, deviated wellbore, horizontal wellbore, or other wellbore. In some aspects, the particular depth of the downhole tool may be relatively deep, such as greater than 10,000 ft. TVD. Thus, in some aspects, a hydrostatic pressure in an annulus of the wellbore, and also in a bore that extends through the downhole tool, may be greater than, and in some cases much greater than, atmospheric pressure.

At depth, a particular one of the tubular members, for example, an outer tubular member or sleeve, for instance, may be exposed (e.g., on an outer surface of the member) to the hydrostatic pressure in the annulus of the wellbore. In such cases, therefore, an inner surface of the outer tubular member may be exposed to atmospheric pressure in the pressure chamber. In some aspects, even though the annulus pressure may be much greater than atmospheric pressure, the outer tubular member may resist deformation (e.g., collapse) based on the outer tubular member being a thick cylinder (e.g., compound cylinder, wire-wrapped cylinder, or auto-frettaged cylinder).

Also at depth, an inner tubular member or mandrel, for instance, may be exposed (e.g., on an inner surface of the member) to the hydrostatic pressure in the bore of the downhole tool. The outer surface of the inner tubular member may be exposed to atmospheric pressure in the pressure chamber. In some aspects, even though the annulus pressure may be much greater than atmospheric pressure, the inner tubular member may resist deformation (e.g., burst) based on the inner tubular member being a thick cylinder (e.g., compound cylinder, wire-wrapped cylinder, or auto-frettaged cylinder).

At depth, the downhole tool may be operated (e.g., set as a packer, set as a plug, operated as a valve, or otherwise based on the type of tool). In some cases, operation of the tool may include moving the outer tubular member relative to the inner tubular member (or vice versa) to adjust a volume of the pressure chamber. In some aspects, the downhole tool may be operated without deformation (e.g., with no deformation or negligible deformation) of one or both of the tubular members based on a hoop stress of the compound cylinders oriented away from a radial direction of force due to a pressure difference between hydrostatic pressure and atmospheric pressure (e.g., inward on an outer tubular member and outward on an inner tubular member).

A number of examples have been described. Nevertheless, it will be understood that various modifications may be made. Accordingly, other examples are within the scope of the following claims.

What is claimed is:

1. A downhole tool, comprising:

a housing comprising a connection for coupling with a conveyance that extends from a terranean surface into a wellbore;

a first tubular member coupled with the housing, the first tubular member comprising a first compound cylinder; and a second tubular member coupled with the housing and concentrically positioned radially adjacent the first tubular member, the second tubular member comprising a second compound cylinder, the first and second tubular members defining a fixedly sealed pressure chamber between an inner surface of the first tubular member and an outer surface of the second tubular member.

2. The downhole tool of claim 1, wherein the pressure chamber comprises a fluid at or near atmospheric pressure.

3. The downhole tool of claim 2, further comprising a bore that extends through the tool and defined by an inner surface of the second tubular member, the bore for at least partially enclosing the fluid at or near a hydrostatic pressure of an annulus between the tool and the wellbore at a downhole position of the tool.

4. The downhole tool of claim 3, wherein the hydrostatic pressure is greater than atmospheric pressure.

5. The downhole tool of claim 3, wherein the pressure chamber is fluidically sealed from the annulus of the wellbore at the downhole position of the tool.

6. The downhole tool of claim 3, wherein at least one of the first or second tubular members is configured to resist deformation based on a difference in the hydrostatic pressure and the atmospheric pressure.

7. The downhole tool of claim 1, wherein at least one of the first or second compound cylinders comprises a plurality of auto-frettage cylindrical members, at least one of the plurality of cylindrical members plastically deformed into another of the plurality of cylindrical members.

8. The downhole tool of claim 7, wherein the one of the plurality of cylindrical members comprises a hoop stress having a radially outward bias.

9. The downhole tool of claim 1, wherein the downhole tool comprises one of a packer, a plug, a setting tool, a tester valve, or an interval control valve.

10. The downhole tool of claim 9, wherein the second tubular member comprises a mandrel and the first tubular member comprises an outer sleeve that rides, at least partially, on the mandrel.

11. A downhole tool system comprising:

a connection sub-assembly that comprises a connector for coupling with a conveyance that extends from a terranean surface into a wellbore;

a hydrostatic sub-assembly that comprises an atmospheric chamber fluidically and fixedly sealed from an annulus of the wellbore by a plurality of tubular members at a downhole position of the system, at least one of the tubular members comprising a thick cylinder; and an actuation sub-assembly comprising an actuation sleeve for actuating the hydraulic sub-assembly based on hydrostatic pressure of the annulus.

12. The downhole tool system of claim 11, wherein the thick cylinder comprises one of a compound cylinder, a wire-wound cylinder, or an autofrettaged cylindrical member.

13. The downhole tool system of claim 12, wherein the thick cylinder is a compound cylinder, and further wherein the compound cylinder comprises at least two tubular members concentrically fitted together having a hoop stress radially biased away from a centerline of the hydrostatic sub-assembly.

14. The downhole tool system of claim 11, wherein a second of the plurality of tubular members comprises a second thick cylinder, the thick cylinder and the second thick cylinder defining the atmospheric chamber, the atmospheric chamber comprising a fluid at or near atmospheric pressure.

15. The downhole tool system of claim 11, wherein the hydrostatic pressure is greater than atmospheric pressure.

16. The downhole tool system of claim 15, wherein the thick cylinder is configured to resist deformation based on a difference in the hydrostatic pressure and the atmospheric pressure.

17. The downhole tool system of claim 16, wherein the hydrostatic pressure is up to about 20,000 psi.

18. A method, comprising:

running a downhole tool connected with a conveyance into a wellbore, the downhole tool comprising:

a housing coupled with the conveyance;

a first tubular member coupled with the housing, the first tubular member comprising a first compound cylinder; and a second tubular member coupled with the housing and concentrically positioned radially adjacent the first tubular member, the second tubular member comprising a second compound cylinder, the first and second tubular members defining a fixedly sealed pressure chamber between an inner surface of the first tubular member and an outer surface of the second tubular member;

setting the downhole tool at a determined depth in the wellbore; and exposing at least one of the first or second tubular members to an annulus pressure in the wellbore that is greater than a fluid pressure in the pressure chamber, where the at least one of the first or second tubular members resists deformation based on the difference in the annulus pressure and the fluid pressure in the pressure chamber.

19. The method of claim 18, further comprising:

exposing at least one of the first or second tubular members to atmospheric pressure in the pressure chamber, the annulus pressure greater than atmospheric pressure.

20. The method of claim 19, further comprising:

exposing an inner radial surface of the second tubular member to the annulus pressure in a bore of the downhole tool;

exposing an outer radial surface of the second tubular member to the atmospheric pressure in the pressure chamber; and operating the downhole tool at the determined depth without deformation of the second tubular member.

21. The method of claim 19, further comprising:

exposing an outer radial surface of the first tubular member to the annulus pressure in an annulus between the downhole tool and the wellbore;

exposing an inner radial surface of the first tubular member to the atmospheric pressure in the pressure chamber; and operating the downhole tool at the determined depth without deformation of the first tubular member.

22. The method of claim 21, wherein operating the downhole tool at the determined depth without deformation of the first tubular member comprises:

operating the downhole tool at the determined depth without deformation of the first tubular member based on a hoop stress of the first compound cylinder oriented in a radially outward direction.

23. The method of claim 21, wherein operating the downhole tool comprises one of:

operating the downhole tool as a packer, operating the downhole tool as a plug, operating the downhole tool as a setting tool, operating the downhole tool as a tester valve, or operating the downhole tool as an interval control valve.

24. The method of claim 21, wherein operating the downhole tool comprises moving the first tubular member relative to the second tubular member to adjust a volume of the pressure chamber.

* * * * *